United States Patent [19]

Reen

[11] 4,236,945

[45] Dec. 2, 1980

[54] PHOSPHORUS-IRON POWDER AND METHOD OF PRODUCING SOFT MAGNETIC MATERIAL THEREFROM

[75] Inventor: Orville W. Reen, New Kensington, Pa.

[73] Assignee: Allegheny Ludlum Steel Corporation, Pittsburgh, Pa.

[21] Appl. No.: 963,717

[22] Filed: Nov. 27, 1978

[51] Int. Cl.[3] ..... H01F 1/02

[52] U.S. Cl. ..... 148/105; 75/201; 75/211; 75/214; 75/230; 75/246; 75/255; 252/62.55; 148/31.55

[58] Field of Search ..... 148/31.55, 105; 75/200, 75/201, 211, 230, 246, 255, 214; 252/62.55; 428/428

[56] References Cited

U.S. PATENT DOCUMENTS

| | | | |
|---|---|---|---|
| 3,836,355 | 9/1974 | Lindskog et al. | 75/0.5 BA |
| 4,000,980 | 1/1977 | Morishita et al. | 75/230 |
| 4,047,893 | 9/1977 | Falkowski et al. | 148/105 |
| 4,090,868 | 5/1978 | Tengzelius et al. | 75/0.5 R |
| 4,093,449 | 6/1978 | Svensson | 75/0.5 R |
| 4,115,158 | 9/1978 | Reen | 148/105 |

OTHER PUBLICATIONS

"Phosphorus as an Alloying Element in Ferrous P/M", Lindskog et al., Modern Developments in Powder Metallurgy, vol. 10, Ferrous and Nonferrous P/M Materials, pp. 97–128, copyright 1977.

"The Influence of Particle Size and Phosphorous Additions on Soft Magnetic Properties of Sintered High Purity Atomized Iron", Tengzelius et al., Presented at Fifth European Symposium on P/M Jun. 4–8, 1978.

*Primary Examiner*—R. Dean
*Assistant Examiner*—John P. Sheehan
*Attorney, Agent, or Firm*—Vincent G. Gioia; William J. O'Rourke, Jr.

[57] ABSTRACT

A phosphorus-iron powder is disclosed for use in the pressing and sintering of soft magnetic parts. This powder comprises a substantially phosphorous free iron powder blended with a sufficient quantity of ferrophosphorus powder having an average particle size of at least 10 micron and a phosphorus content of from 18 to 30%, to arrive at a phosphorus content for the mixture in a range of from about 0.40 to 1.25%. By pressing the blended mixture to a green density of at least 6.0 grams per cubic centimeter, and sintering the pressed mixture in a nonoxidizing atmosphere at a temperature of at least 1900°F., the part linear shrinkage during sintering is less than 2%.

4 Claims, No Drawings

PHOSPHORUS-IRON POWDER AND METHOD OF PRODUCING SOFT MAGNETIC MATERIAL THEREFROM

BACKGROUND OF THE INVENTION

1. Field of Invention

The present invention relates to a powder material for use in the pressing and sintering of soft magnetic parts and more particularly to an iron powder, ferrophosphorus powder mixture which experiences part linear shrinkage less than 2% during sintering thereof.

2. Description of the Art

The prior art such as "Phosphorus as an Alloying Element in Ferrous P/M", by P. Lindskog, et al., Modern Developments in Powder Metallurgy, Volume 10, Ferrous and Nonferrous P/M Materials, pages 97–128, copyright 1977, from the proceedings of the 1976 International Powder Metallurgy Conference, teaches that shrinkage of iron powder parts increases significantly as the phosphorus content of the powder mixture increases beyond about 0.30%. In the production of soft magnetic materials from iron powder, the phosphorus content significantly exceeds 0.30% and typically must be within the range of about 0.40 to 1.25% phosphorus. Phosphorus contents within such range enhances the magnetic properties, increasing induction for example, of the sintered iron-phosphorus alloy. Furthermore, more complete sintering is obtained with such phosphorus additions thereby beneficially increasing the density of the sintered soft magnetic part. Understandably, part shrinkage during sintering of soft magnetic parts having a phosphorus content within the range of from 0.40 to 1.25% is a problem.

It is highly desirable, from a cost and efficiency standpoint, to prepare precision magnetic parts in molds of fixed dimensions. The pressed or green part has fixed dimensions which ideally would not change during subsequent sintering. Control of shrinkage during sintering, therefore, is desired to produce parts within specified dimensional tolerances. To achieve such results, part linear shrinkage during sintering is preferably less than 2% of the die dimension. Reducing shrinkage to such close tolerances minimizes and perhaps eliminates part machining requirements prior to usage of the parts.

Recognizing that part shrinkage during sintering is a problem, initial attempts at dealing with shrinkage involved constructing dies in such a manner as to compensate for shrinkage. It was soon discovered that part shrinkage varied with each powder lot and therefore, could not be accurately predicted. Thus, additional process steps, such as re-pressing or sizing was necessary more often than not. Compensation for shrinkage also proved to be an expensive proposition because of the costs of the dies. Efforts were then directed to controlling shrinkage rather than compensating for it, as the practical solution.

The prior art such as Eisenkolb, F, Stahl und Eisen, 79 (1959) pp 1345–1352, and Bockstiegel, G, Metallurgie III, 4 (1962) pp 67–78, which were discussed in the above cited article, taught that overall dimensional change could be brought closer to zero by the additions of copper. It is really copper growth during sintering which counteracts phosphorus shrinkage. It is also taught in the above cited article by Lindskog et al. that carbon additions stabilize the dimensional change of iron-phosphorus powder during sintering. To maximize the magnetic properties of the sintered iron-phosphorus alloys, impurities in the iron must be minimized and, in particular, copper and carbon must be as low as possible. It is well known that carbon additions add strength to phosphorus containing, sintered iron parts. While strength may be desirable for structural parts, strength is not a primary concern for magnetic parts. In particular, the magnetic properties are lowered as stress is applied to the material, therefore the stress, or load, applied to the magnetic parts of this invention must be minimized.

Another reference, "The Influence of Particle Size and Phosphorus Additions on the Soft Magnetic Properties of Sintered High Purity Atomized Iron" J. Tengzelius and Sten-Ake Kvist, Hoganas AB/Sweden, presented at the Fifth Europeon Symposium on P/M, "P/M 78 SEMP 5", Stockholm, Sweden, June 4–8, 1978, includes a disclosure regarding the effect of particle size on dimensional changes of sintered iron-phosphorus soft magnetic parts. It is interesting to note that this article only discusses the effects of the size of the iron powder, and concludes that the magnetic properties of sintered iron materials may be improved by using coarse atomized iron powder.

Tengzelius et al. U.S. Pat. No. 4,090,868 and Svensson et al. U.S. Pat. No. 4,093,449 disclose that ferrophosphorus powder, having a phosphorus content in excess of 2.8% may be mixed with iron powder and sintered without experiencing the usual brittleness problems. Tengzelius et al. teach that impact strength is enhanced by controlling the quantity of impurities, such as silicon, aluminum, magnesium and titanium, in the ferrophosphorus powder. These patents also disclose the desirability of using ferrophosphorus having a small particle size preferably less than 10 microns, which is the exact opposite of the teaching of the present invention.

Lindskag et al. U.S. Pat. No. 3,836,355 pertains to an iron-phosphorus alloy powder made by blending ferrophosphorus having a relatively low, 12 to 16%, phosphorus content, and a maximum particle size of 75 micron with a substantially phosphorus free steel powder having a maximum particle size of from 100 to 500 micron. Pressing and sintering of such powder combinations, which may include carbon and copper impurities, appears to produce a high density article with satisfactory strength and without great dimensional changes, growth or shrinkage, during sintering.

Accordingly, an improved method of pressing and sintering a mixture of iron powder and ferrophosphorus powder containing from 18 to 30% phosphorus, in the production of soft magnetic parts containing from 0.40 to 1.25% phosphorus, is desired in which part linear shrinkage during sintering is less than 2%.

SUMMARY OF THE INVENTION

This invention may be summarized as providing a phosphorus-iron powder for use in the pressing and sintering of soft magnetic parts. This powder comprises a substantially phosphorus free iron powder blended with a sufficient quantity of ferrophosphorus powder having an average particle size of at least 10 micron and a phosphorus content of from 18 to 30%, to arrive at a phosphorus content for the mixture in a range of from about 0.40 to 1.25%. The process of pressing the blended mixture to a green density of at least 6.0 grams per cubic centimeter, and sintering the pressed mixture in a nonoxidizing atmosphere at a temperature of at least 1900° F. results in part linear shrinkage during sintering of less than 2%.

Among the advantages of the present invention is the provision of a phosphorus-iron powder that exhibits part linear shrinkage of less than 2% when pressed and then sintered into a soft magnetic part.

An objective of this invention is to provide a method of producing a phosphorus bearing soft magnetic material by pressing and sintering a particular blend of iron powder with ferrophosphorus powder in which part linear shrinkage during sintering is less than 2%.

The advantage of limiting part linear shrinkage during sintering to less than 2% is that precision soft metallic parts may be made by commercially acceptable powder metallurgical techniques without requiring subsequent machining or other part dressing after sintering.

A further objective of this invention is to to provide a method of minimizing part shrinkage while maintaining the magnetic properties of the soft magnetic part.

The above and other objectives and advantages of this invention will be more fully understood and appreciated with reference to the following detailed description.

DESCRIPTION OF THE PREFERRED EMBODIMENTS

The present invention is directed to a phosphorus-iron powder comprising a particular blend of an iron powder and a ferrophosphorus powder. The iron powder which comprises the majority of the iron-phosphorus powder mixture includes any powder that contains at least 98% iron. Typically, such powder is produced by impingement of high pressure fluid, liquid or gas, on a molten stream of metal by well known techniques to produce an atomized steel powder. A typical atomized steel powder has the following properties:

| Chemical Analysis | |
|---|---|
| Constituent | Weight Percent |
| Carbon | 0.0037 |
| Manganese | 0.12 |
| Phosphorus | 0.005 |
| Sulfur | 0.011 |
| Silicon | 0.014 |
| Chromium | 0.075 |
| Nickel | 0.010 |
| Aluminum | 0.002 |
| Molybdenum | 0.005 |
| Copper | 0.001 |
| Titanium | 0.004 |
| Tin | 0.011 |
| Calcium | 0.012 |
| Magnesium | 0.002 |
| Iron | Balance |

| Screen Analysis | |
|---|---|
| Sieve Size (Mesh) | Weight Percent |
| +60 | Trace |
| −60/+80 | 6.0 |
| −80/+100 | 8.2 |
| −110/+140 | 17.9 |
| −140/+200 | 21.4 |
| −200/+325 | 24.1 |
| −325 | 22.4 |

The ferrophosphorus powder of the present invention is typically made by crushing a cast ferrophosphorus material. Ferrophosphorus is a brittle material normally produced by melting and casting. After solidification, the brittle material may be pulverized by conventional ore dressing techniques such as crushing, grinding, or milling. In order to provide a uniformly sized product, chunks of ferrophosphorus varying in size of up to about 4 inches in diameter may be crushed and screened to obtain various mesh fractions.

Ferrophosphorus powder having a phosphorus content of from 18 to 30% phosphorus as required by the present invention is available, commercially, from many producers. Such powder may have to be refined and sized prior to use in accordance with the present invention. Refining of the ferrophosphorus powder may be accomplished, for example, to reduce the calcium content to less than 0.20%. Sizing of the ferrophosphorus powder should substantially eliminate a sufficient quantity of the very fine portion of the powder to insure that the average particle size of the powder is at least ten (10) micron. It has been found that linear shrinkage during sintering of the pressed powder blend of the present invention is less than two percent even if the average particle size of the ferrophosphorus powder is as high as 200 mesh (74 micron) and it is believed that shrinkage would not be affected with ferrophosphorus powder having an average particle size as high as 100 mesh (149 micron). It will be understood by those skilled in the art that using coarse ferrophosphorus powder will result in parts which exhibit larger, more visible pores therethrough as a result of sintering. Such large pores may not be desirable for structural applications which require part strength, but the pores have not been found detrimental for magnetic applications.

In accordance with the present invention, ferrophosphorus powder and substantially phosphorus free iron powder, as described above, are blended in sufficient quantities to arrive at a calculated phosphorus content for the mixture in a range of from about 0.40 to 1.25%, and more preferably in a range of from 0.45 to 0.75%. It should be understood that conventional solid lubricants, such as zinc stearate or stearic acid may also be blended with the powders in quantities that will vary according to part geometry to facilitate ejection of the pressed parts from a molding die. It should also be understood that impurities in the blended mixture must be minimized, and in particular carbon and copper should each be held below about 0.01% in order to retain the magnetic properties in the pressed and sintered part.

In an exemplary process for producing phosphorus bearing soft magnetic materials in accordance with the present invention, a ferrophosphorus powder having a phosphorus content of 19.47% was blended with substantially phosphorus free iron powder in sufficient quantities to arrive at a phosphorus content of 0.75% for the blended mixture. Various particle sizes of ferrophosphorus powder were employed for comparison purposes. Regardless of the particle size, all mixtures were compacted to a green density of from 6.65 to 6.71% grams per cubic centimeter or 84.5 to 85.3% of the theoretical density of iron of 7.87 grams per cubic centimeter. The green compacts were sintered for sixty minutes in a vacuum furnace with a pressure of 13.3 pascals maintained with hydrogen. After sintering at a temperature of 1260° C. (2300° F.) the pressed and sintered parts were cooled to ambient temperature. The compact diameter was measured with an optical gage, such as Model DR-25C produced by Bausch & Lomb Co. Shrinkage of the compact was then calculated as a percentage of the molding die diameter, as shown below:

TABLE I

| Example | Avg. Particle Size Ferrophosphorus | Linear Shrinkage (%) |
|---|---|---|
| 1 | 1.6 Micron | 2.43 |
| 2 | 5.9 Micron | 2.58 |
| 3 | 9.3 Micron | 2.15 |
| 4 | 14.0 Micron | 1.31 |
| 5 | 17.0 Micron | 1.27 |
| 6 | 24.0 Micron | 1.19 |

The above examples illustrate that linear shrinkage exceeds two percent (2%) if the ferrophosphorus particle size of the particular blend is less than 10 micron.

In another set of examples, the greater than ten micron ferrophosphorus powder that was used for examples 4, 5 and 6 of the above mixture, was blended with substantially phosphorus free iron powder in sufficient quantities to arrive at a phosphorus content of 0.45% for the blended mixture. The following results indicate that linear shrinkage during sintering under the same conditions as set forth above was considerably less than two percent (2%) when the phosphorus content of the mixture was reduced from 0.75 to 0.45%.

TABLE II

| Example | Avg. Particle Size Ferrophosphorus | Linear Shrinkage (%) |
|---|---|---|
| 7 | 14.0 Micron | 0.64 |
| 8 | 17.0 Micron | 0.80 |
| 9 | 24.0 Micron | 0.40 |

Blended mixtures having a phosphorus content of 0.75% were pressed and sintered in accordance with the process as outlined above, with the exception that sintering temperature was varied. The following results show that part linear shrinkage of mixtures blended in accordance with the present invention is held under two percent regardless of sintering temperature.

TABLE III

| Example | Avg. Particle Size Ferrophosphorus | Sintering Temperature | Linear Shrinkage (%) |
|---|---|---|---|
| 10 | 14.0 Micron | 2200° F. (1204° C.) | 1.03 |
| 11 | 17.0 Micron | 2200° F. (1204° C.) | 0.80 |
| 12 | 24.0 Micron | 2200° F. (1204° C.) | 0.56 |
| 13 | 14.0 Micron | 2100° F. (1149° C.) | 0.60 |
| 14 | 17.0 Micron | 2100° F. (1149° C.) | 0.40 |
| 15 | 24.0 Micron | 2100° F. (1149° C.) | 0.32 |

In the following examples a ferrophosphorus powder having a phosphorus content of 24.66% was blended with substantially phosphorus free iron powder in sufficient quantities to arrive at a phosphorus content of 0.75% for the blended mixture. Various particle sizes of ferrophosphorus powder were employed for comparison purposes. All of these mixtures were compacted to a green density of from 6.76 to 6.84 grams per cubic centimeter or 85.9 to 86.9 percent of the theoretical density of iron of 7.87 grams per cubic centimeter. The compacts were sintered at a temperature of 2200° F., and then resintered at a temperature of 2300° F. with the following results:

TABLE IV

| Example | Avg. Particle Size Ferrophosphorus | Linear Shrinkage (%) |
|---|---|---|
| 16 | 1.51 Micron | 2.95 |
| 17 | 4.61 Micron | 2.54 |
| 18 | 7.70 Micron | 2.23 |
| 19 | 10.8 Micron | 1.79 |
| 20 | 13.9 Micron | 1.31 |

The above results, as shown in Table IV, indicate that part shrinkage of the particular blend of ferrophosphorus and iron powder is less than two percent (2%) as long as the particle size of the ferrophosphorus powder is at least ten micron, and that shrinkage is minimized even in resintering situations.

It is significant that the ferrophosphorus powder used for examples 17, 18 and 19 was a calculated blend of powders having various average particle sizes. The powders were blended empirically to arrive at a calculated average particle size for the ferrophosphorus powder used in the example. The linear shrinkage was found to follow a straight line relationship with particle size, whether the average particle size was measured or calculated. Such relationship indicates that in certain instances powder blending may be performed empirically to obtain a desired or required linear shrinkage during sintering.

The magnetic properties of soft magnetic materials made in accordance with the process of the present invention are not affected by variations in the particle size of the ferrophosphorus powder. To illustrate this fact, a variety of sizes of ferrophosphorus powders were pressed and sintered in accordance with the present invention and the following magnetic properties obtained from a 10 kilogauss induction hysteresis loop:

TABLE V

| Ferrophosphorus Particle Size | Sintered Density ($g/Cm^3$) | Max. Magnetizing Force (Oersteds) | Remanance (Gauss) | Coercive Force (Oersteds) |
|---|---|---|---|---|
| −100/+200 mesh | 7.06 | 1.87 | 9200 | 0.753 |
| −200/+325 mesh | 7.13 | 1.58 | 9300 | 0.688 |
| 13.2 micron avg. | 7.08 | 1.63 | 9300 | 0.736 |
| 3.45 micron avg. | 7.16 | 1.76 | 9300 | 0.818 |

Whereas, the particular embodiments of this invention have been described above for the purposes of illustration it will be apparent to those skilled in the art that numerous variations of the details may be made without departing from the invention.

What is claimed is:

1. A phosphorus-iron powder for use in the pressing and sintering, at less than 2% linear shrinkage, of soft magnetic parts while retaining the magnetic properties of the parts, comprising a substantially phosphorus free powder containing at least 98% iron blended with a sufficient quantity of ferrophosphorus powder having an average particle size of at least 10 micron and a phosphorus content of from 18 to 30%, to arrive at a phosphorus content for the mixture in the range of from about 0.40 to 1.25% and less than 0.01% carbon or copper impurities in the mixture.

2. A powder as set forth in claim 1 wherein the phosphorus content for the mixture is in a range of from about 0.45 to 0.75%.

3. In a process for producing a phosphorus bearing soft magnetic material while retaining the magnetic properties of the parts, which process includes the steps of: blending powder containing at least 98% iron with ferrophosphorus powder having a phosphorus content of from 18 to 30%, into a mixture containing from about 0.40 to 1.25% phosphorus and less than 0.01% carbon or copper impurities, pressing the blended mixture to a green density of at least 6.0 grams per cubic centimeter, and sintering the mixture in a nonoxidizing atmosphere at a temperature of at least 1900° F., wherein the improvement comprises the step of blending ferrophosphorus powder having an average particle size in excess of 10 micron, whereby part linear shrinkage during sintering is less than 2%.

4. A process as set forth in claim 3 wherein the iron powder is blended with ferrophosphorus powder into a mixture containing 0.45 to 0.75% phosphorus.

* * * * *